United States Patent [19]

Okamoto et al.

[11] Patent Number: 4,928,145

[45] Date of Patent: May 22, 1990

[54] DEVELOPING APPARATUS HAVING A BUCKET ROLLER WITH MOVABLE BUCKETS

[75] Inventors: Hiroshi Okamoto; Tateki Oka; Mineyuki Sako; Tetsuo Kyogoku; Toshikazu Suzuki, all of Osaka, Japan

[73] Assignee: Minolta Camera Kabushiki Kaisha

[21] Appl. No.: 178,344

[22] Filed: Apr. 6, 1988

[30] Foreign Application Priority Data

Apr. 9, 1987 [JP] Japan ..... 62-53836[U]

[51] Int. Cl.[5] ..... G03G 15/00; G03G 15/09; G03G 9/08

[52] U.S. Cl. ..... 355/245; 355/251; 118/657; 430/122

[58] Field of Search ..... 355/3 R, 3 DD, 14 D; 118/656–658; 430/120, 122

[56] References Cited

U.S. PATENT DOCUMENTS 3,635,553 1/1972 Adamek et al. ..... 355/3 DD
4,194,465 3/1980 Tsukamoto et al. ..... 355/3 DD X
4,449,810 5/1984 Ikesue et al. ..... 118/658 X
4,633,807 1/1987 Jacobs ..... 118/657

FOREIGN PATENT DOCUMENTS 58-149079 9/1983 Japan .

*Primary Examiner*—A. T. Grimley
*Assistant Examiner*—Edward Pipala

[57] ABSTRACT

The disclosure relates to a developing apparatus having a developing sleeve for making a latent image visible and a bucket roller for supplying developer to the developing sleeve including a plurality of buckets provided on the circumferential surface of the bucket roller at a predetermined spacing and base portions for supporting the buckets respectively.

Each of the buckets are loosely provided at the base portions respectively so as to pivot with respect to the base portions. This construction effectively prevents the aggregation and accumulation of developer at the bucket portion, as well as gives sufficient flowability to the developer.

6 Claims, 6 Drawing Sheets

DEVELOPING APPARATUS HAVING A BUCKET ROLLER WITH MOVABLE BUCKETS

FIELD OF THE INVENTION

The present invention relates to a developing apparatus for use in a copying machine or the like, and more particularly to a developing apparatus which prevents developer from aggregating.

BACKGROUND OF THE INVENTION

When a copying machine is continuously operated for a long time, developer contained in a developing apparatus is aggregated to accumulate on a bucket of a bucket roller, impairing flowability of the developer. Many of the conventional developing apparatuses are provided with a bucket roller to which a bucket for transporting developer is fixed by a screw or the like. Therefore, developer is liable to aggregate on the bucket and thereabout when a copying machine is continuously operated, making it impossible to eliminate the accumulation of the developer as mentioned above. As a result, there has been a strong demand for improving this point.

In view of this, for example, a technique for preventing the accumulation of the developer has been proposed as shown in FIG. 1 wherein a bucket 103 fixedly provided to a bucket roller 102 for supplying the developer to a developing sleeve 101 disposed adjacent to a photosensitive member PC is given vibration at its side portion by a vibration member 104 provided at the main body of the developing apparatus.

Since the structure of the above-mentioned conventional developing apparatus is such that the bucket fixedly provided at the bucket roller by a spring or the like is supplied at its side a light vibration which does not affect the rotation of the bucket roller, vibration cannot be transmitted entirely over the bucket, only the portion thereof colliding with the vibration member vibrating. Consequently, although the aggregation and accumulation of the developer on the bucket can partly be prevented, the function sufficient to assuredly prevent such aggregation and accumulation of the developer all over the bucket cannot be obtained.

SUMMARY OF THE INVENTION

A main object of the present invention is to provide a developing apparatus capable of assuredly preventing the aggregation and accumulation of the developer at the bucket portion, as well as of affording sufficient flowability to the developer.

To accomplish the above-mentioned object, a developing apparatus of the present invention comprises a photosensitive member bearing thereon an electrostatic latent image of an original, a developing sleeve rotatably provided and disposed to confront with the photosensitive member with a predetermined distance therebetween, and a bucket roller for supplying developer to the developing sleeve including a plurality of buckets arranged at a predetermined spacing on the circumference of the bucket roller with its support shaft as a center and base portions for supporting each of said buckets, said plurality of buckets being loosely fitted at said base portions respectively so as to be pivotable integral with the rotation of the bucket roller with respect to the base portions.

A developing apparatus of the preferred embodiment of the present invention is characterized in that said plurality of buckets are made of magnetic materials and are loosely provided to move with respect to the base portions.

In the developing apparatus of the present invention, a plurality of buckets for supplying developer to the developing sleeve are loosely provided or fitted at the base portions respectively so as to pivot with the rotation of the bucket roller. Therefore, the buckets, when reaching the predetermined position, are downwardly inclinded due to the forces such as centrifugal force, gravity and the like to contact with the base portions of the bucket. This produces impact which is transmitted to the developer transported by the buckets, causing vibration of the developer. Consequently, the developer is less prone to aggregate and has excellent flowability.

Further, in the more preferred developing apparatus of the present invention, a plurality of buckets for supplying developer to the developing sleeve are made of magnetic materials and are loosely provided at the base portions respectively so as to pivot with the rotation of the bucket roller. Therefore, the buckets, when reaching the predetermined position, are attracted by a magnetic force of the magnetic roller as well as gravity to move in an amount of play at the base portions. At that time, the bucket is in contact with the base portion to stop its movement, giving rise to impact which is transmitted to the developer transported by the buckets. Consequently, the developer is less prone to aggregate and has excellent flowability.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS (First embodiment)

Figure 1:
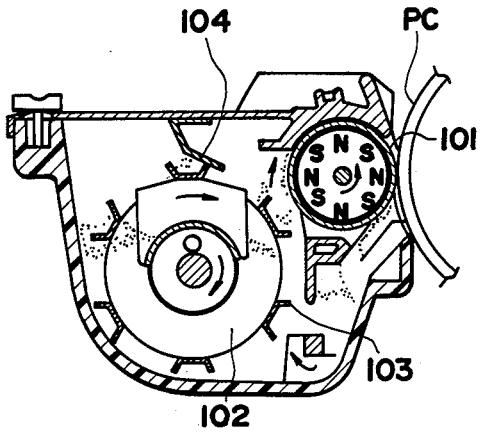
FIG. 1 Prior Art
FIG. 1 is a sectional view of a conventional developing apparatus.
Figure 2:
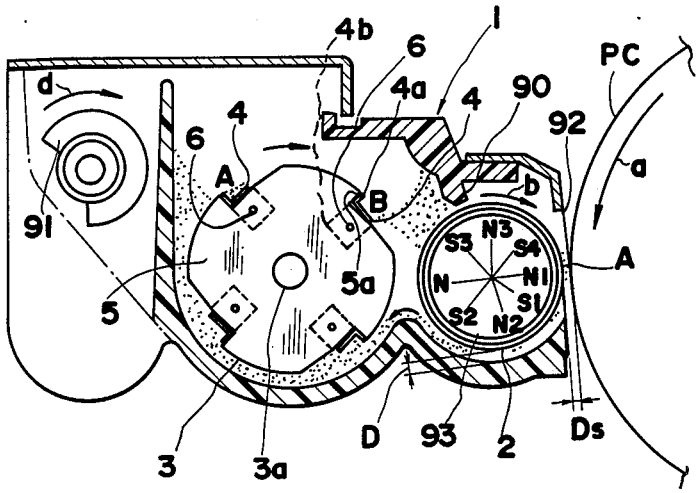
FIG. 2 is a fragmentary side view schematically showing a developing apparatus of a first preferred embodiment of the present invention which is employed in a copying apparatus.

FIG. 2 is a fragmentary side view schematically showing an essential portion of a developing apparatus of the present invention which is applied to a copying apparatus.

The apparatus of the present invention comprises a developing sleeve 2 rotatably provided at a predetermined spacing from a photosensitive member PC for visualizing a latent image formed on the photosensitive member PC and a bucket roller 3. Other components, except for the above-mentioned components, such as developer height regulating plate 90, a transport screw 91, a blade for preventing toner from scattering and the like are similar to those employed in a conventional developing apparatus for use in a copying apparatus, so that the detailed explanation will be omitted here. The above-mentioned developing sleeve 2 includes in its inside a rotatable or fixed magnetic roller 93 as already known.

Figure 3:
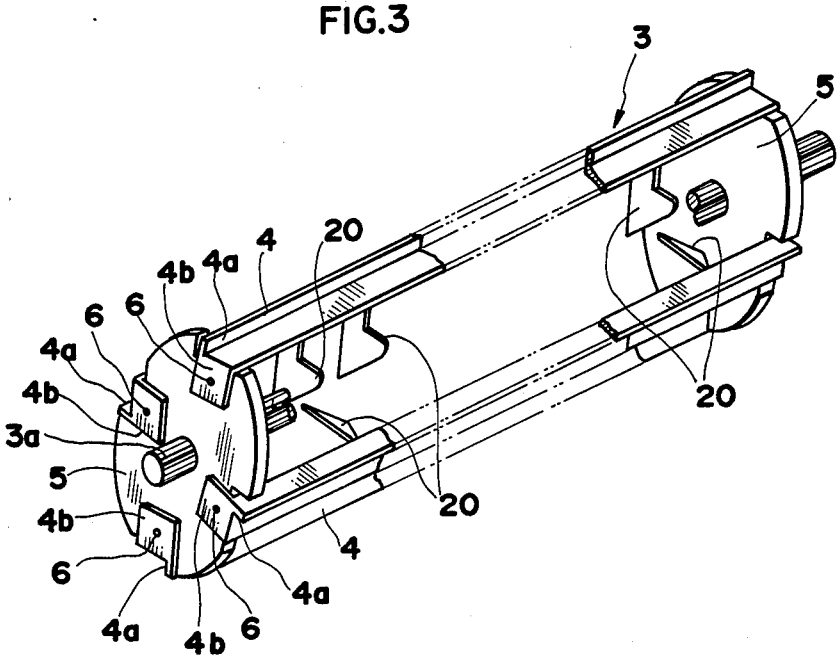
FIG. 3 is a perspective view schematically showing a bucket roller housed in the developing apparatus of the first embodiment.

The bucket roller 3 of the developing apparatus according to the present invention comprises as perspectively shown in FIG. 3 a pair of side plates 5 fixedly provided at both ends of a support shaft 3*a*, a plurality of buckets 4 arranged in a circumferential direction of the side plate 5 at a predetermined spacing and a plurality of agitating blades 20 provided at each bucket in its lengthwise direction at a predetermined spacing.

Figure 4:
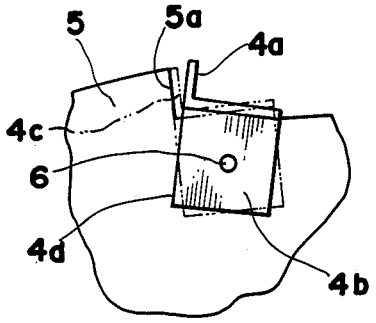
FIG. 4 is a schematic view showing the movement of the bucket of the first embodiment.

Each bucket 4 is consisted of an L-shaped portion 4*a* for receiving and transporting the developer and attached portions 4*b* attached to the side plates 5 at the both ends of the L-shaped portion 4*a* so as to pivot about a fixed member 6 such as a screw. The bucket holds the state as shown by a chain line in FIG. 4 in the vicinity of the position A shown in FIG. 2 due to gravity, centrifugal force or the like, whereas it is downwardly inclinded when reaching near the position B by the rotation of the bucket roller 3. The bucket 4, when inclinded downwardly, partly collides with a wall 5*a* of the side plate 5 provided at the bucket roller 3, bringing the bucket to the state 4*d* as shown by a solid line in FIG. 4 with impact.

As described above, the bucket 4 loosely provided at the side plates 5 of the bucket roller 3 by the fixed member 6 is downwardly inclined due to gravity etc. upon the rotation of the bucket roller 3 and then collides with a certain impact against the wall 5*a* of each side plate 5. Accordingly, the vibration of the entire bucket 4 transmits a sufficient vibration to the whole developer supplied and transported by the bucket 4, preventing the aggregation of the developer. As a result, the developer has improvided flowability. Consequently, the developer is uniformly supplied in the axial direction of the developing sleeve, by which result the development can be carried out without density irregularities. Further, flowability of the whole developer can be improved since the developer is given flowability every time the developer is scooped up by the buckets.

It is more effective that the agitating blades 20 attached to the bucket 4 pivot with the bucket. In this embodiment, the agitating blades 20 are directly attached to the bucket 4 as described above to thereby pivot integrally with the bucket 4.

(Second embodiment)

Figure 5:
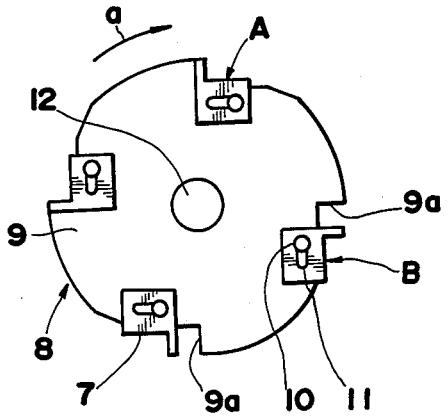
FIG. 5 is a schematic side view showing an essential portion of the second preferred embodiment.

The difference in construction between the first and second embodiments lies in a bucket roller 8 as shown in FIG. 5. More specifically, the bucket roller 8 comprises a plurality of buckets 7 provided with an elongated slit 11 at both ends of each bucket and a pair of side plates 9 having a shaft 10 engaged with this elongated slit 11. The bucket 7 is supported so as to pivot through the elongated slit 11 with respect to the shaft 10 disposed at the pair of side plates 9. Other components, not shown, such as a developing sleeve, developer height regulating plate, transport screw, blade for preventing toner from scattering or the like in the second embodiment are the same as those employed in the developing apparatus of the first embodiment, so that the detailed explanation about these components will be omitted here.

Figure 6:
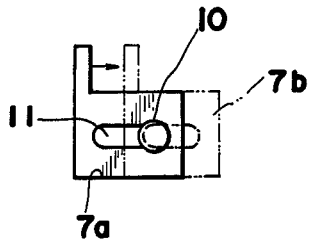
FIG. 6 is a schematic view showing the movement of the bucket shown in FIG. 5.

When the bucket roller 8 rotates upon a rotation support shaft 12 in the direction of an arrow a shown in FIG. 5, the bucket 7 holds a state 7*a* shown by a solid line in FIG. 6, while the bucket 7 moves downwardly due to gravity at the position B, causing the shaft 10 to slide in the elongated slit 11. This makes the bucket 7 to move to a state 7*b* as shown by a chain line in FIG. 6. In this embodiment, impact is produced since a wall 9*a* of each side plate 9 and/or the ends of the elongated slit 11 collides strongly against the shaft 10 when the bucket 7 moves from the position 7*a* to the position 7*b* or from the position 7*b* to the position 7*a*.

Therefore, it is greatly possible to prevent the aggregation and accumulation of the developer at the bucket as well as to assure excellent flowability of the developer owing to the vibration of the developer which is caused by making use of this impact. Besides these, the same effects can be obtained as those obtained in the first embodiment.

Figure 7:
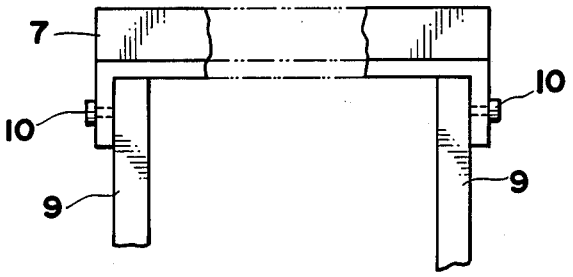
FIGS. 7 and 8 are front views showing the bucket as installed to the bucket roller shown in FIG. 5.
Figure 8A:
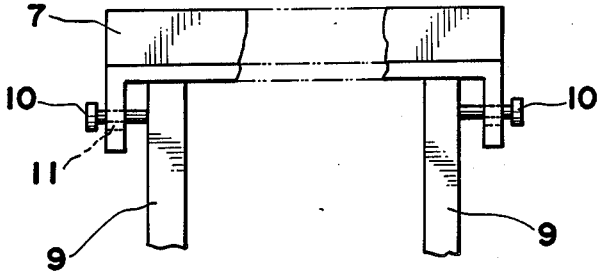
Figure 8B:
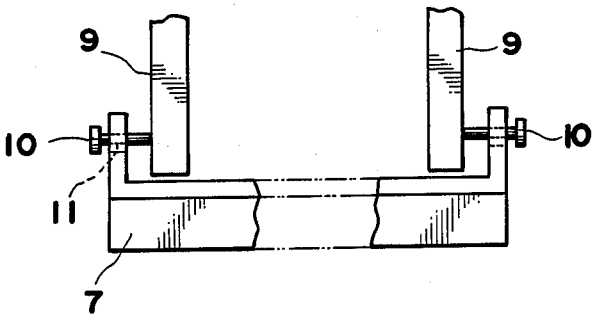

Next, the attachment of the bucket 7 to the bucket roller 8 will be explained with reference to FIGS. 7 and 8. In the case where the bucket 7, which is so constructed as to be attracted to move by the magnetic force and gravity, is attached to each side plate 9 at its engaging portion with less amount of play as shown in FIG. 7, the developer cannot be moved because of the clogging of the developer at the engaging portion. In view of this, the apparatus of this embodiment has a construction shown in FIGS. 8A and 8B such that a somewhat large distance is formed between the outside surface of the side plate 9 and the bucket 7 and also that a width of the elongated slit 11 is made wider than that of the shaft 10. FIG. 8A illustrates the state where the bucket 7 is positioned upward of the bucket roller 8, while FIG. 8B illustrates the state where the bucket 7 is positioned downward of the bucket roller 8. Thus, the developer flows out without accumulating at the engaging portion since a space is formed between the bucket 7 and the engaging portion of the side plate 9. This eliminates the inferior movement of the bucket 7 due to the accumulation of the developer.

(Third embodiment)

The difference between the second and third embodiments lies in the bucket 7 illustrated in FIG. 5. More specifically, the bucket 7' of the third embodiment is made of materials containing magnetic member.

Figure 9:
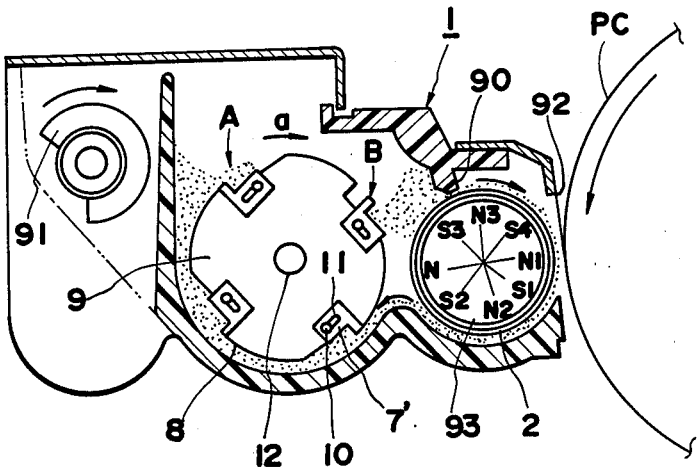
FIG. 9 is a fragmentary side view schematically showing a developing apparatus of a third preferred embodiment of the present invention which is employed in a copying apparatus.
Figure 10:
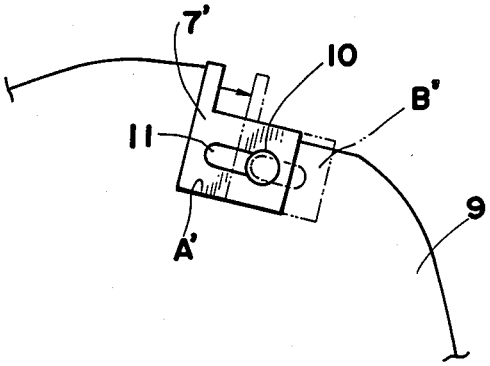
FIG. 10 is a side view showing the movement of the bucket attached to the bucket roller shown in FIG. 9.

FIG. 9 is a sectional view schematically showing an essential portion of the third embodiment. When the bucket roller 8 rotates upon the rotating support shaft 12 in the direction of an arrow a shown in FIG. 9, the bucket 7′ is, in the vicinity of the position A in FIG. 9, located at the position A′ represented by a solid line in FIG. 10 due to gravity or the like, while in the vicinity of the position B in FIG. 9, it moves to the position B′ represented by a double-dot-and-dash line in FIG. 10 due to gravity and the magnetic force which is produced because the bucket 7′ is made of magnetic materials. At that time, the end of the elongated slit 11 of the bucket 7′ collides strongly with the shaft 10 to thereby produce a great impact. Consequently, it is greatly possible to assuredly separate the developer from the bucket 7′ for preventing the aggregation and accumulation of the developer at the bucket as well as to assure excellent flowability by making use of this impact. As a result, the same effects as obtained in the first embodiment, such as development without density irregularities, excellent flowability of the developer, can also be obtained in this embodiment. Further, this embodiment is more effective in that the agitating blades 20 attached to the bucket 7′ move integral with the bucket 7′.

The bucket 7′ according to the present embodiment contains paramagnetic members with its magnetic susceptibility set within the range of $10^{-4}$ to $10^{-6}$ emu/g (20° C.). Moreover, the polarity of $S_3$ of the magnetic roller 93 is set to have a magnetic force of more than 600 Gaus, and carriers to be used to have a magnetization in the range of 65 to 70 emu/g. This is to prevent the difficulty in separating carriers containing magnetic member from the bucket 7′, such difficulty arising because the bucket 7′ is made of materials containing magnetic member, i.e. an aluminum in which magnetic particles are uniformly disposed. The above-mentioned structure makes the suction force between the carriers and the magnetic roller 93 greater than that between the carriers and the bucket 7′. Additionally, the impact mentioned above is given to the bucket 7′, by which result the carriers on the bucket 7′ are assuredly transported to the developing sleeve 2.

Moreover, the bucket 7′ is made of materials containing magnetic member, which enables the bucket 7′ to scoop up much more developer by suction force due to the magnetic force thereof, affording good supplying ability of the developer. Considering the individual bucket 7′, it can scoop up at one time the developer with increased amount and also possesses an excellent supplying ability of the developer to the developing sleeve 2, with the result that it can supply greater amount of the developer at one time to the developing sleeve 2. Therefore, the number of the buckets 7′ can be decreased, by which result an excessive stress is not imposed on the developer and further, manufacturing cost can be reduced. The bucket 7′ per se may be formed of magnetic member.

As explained in the second embodiment, the portion of the bucket 7′ corresponding to the engaging portion of the bucket 7 engaged with the side plate 9 which is shown in FIGS. 8A and 8B and is formed of materials not containing magnetic member effectively prevents the clogging of the developer thereat.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A developing apparatus comprising:

developing means for developing an electrostatic latent image formed on a photosensitive member; and supplying means for supplying developer to said developing means including a bucket roller rotatably mounted and provided with a plurality of buckets on its periphery, said plurality of buckets being provided respectively to said bucket roller so as to move freely in accordance with the rotation of said bucket roller, and said bucket roller being given an impact due to the movement of each of said buckets.

2. A developing apparatus comprising:

developing means for developing an electrostatic latent image formed on a photosensitive member, said developing means including a developing sleeve arranged oppositely to said photosensitive member at a predetermined spacing from the member; and supplying means for supplying developer to the surface of said developing sleeve, said supplying means including a bucket roller rotatably provided, a plurality of buckets arranged on the circumference of said bucket roller at a predetermined spacing and support members for supporting each of said buckets, each of said buckets being provided to each of said support members so as to move loosely, whereby each of said buckets moves upon rotation of said bucket roller to contact with each of said support members to thereby give an impact to said bucket roller.

3. A developing apparatus as claimed in claim 2 wherein each of said buckets is supported to an axis of each support member so as to rotate by its own weight upon rotation of the bucket roller.

4. A developing apparatus as claimed in claim 2 wherein each of said buckets is provided with a slit and supported to an axis of each support member through said slit so as to move along said slit upon rotation of the bucket roller.

5. A developing apparatus as claimed in claim 2 wherein each of said buckets is made of materials containing a magnetic member.

6. A developing apparatus as claimed in claim 2 wherein each of said buckets is provided with a plurality of agitating members in its lengthwise direction at a predetermined spacing.

* * * * *